US006183070B1

(12) United States Patent
Hashizume

(10) Patent No.: US 6,183,070 B1
(45) Date of Patent: Feb. 6, 2001

(54) INK JET RECORDING HEAD AND PROCESS OF MANUFACTURING THE INK JET RECORDING HEAD

(75) Inventor: Tsutomu Hashizume, Nagano (JP)

(73) Assignee: Seiko Epson Corporation, Tokyo (JP)

( * ) Notice: Under 35 U.S.C. 154(b), the term of this patent shall be extended for 0 days.

(21) Appl. No.: 08/957,017

(22) Filed: Oct. 24, 1997

(30) Foreign Application Priority Data

Oct. 24, 1996 (JP) ..... 8-282723

(51) Int. Cl.[7] ..... B41J 2/05
(52) U.S. Cl. ..... 347/70
(58) Field of Search ..... 347/68–72

(56) References Cited

U.S. PATENT DOCUMENTS

| | | | | |
|---|---|---|---|---|
| 4,752,788 | * | 6/1988 | Yasuhara | 347/68 |
| 5,144,342 | * | 9/1992 | Kubota | 347/70 |
| 5,265,315 | | 11/1993 | Hoisington et al. . | |
| 5,465,108 | * | 11/1995 | Fujimoto | 347/71 |
| 5,639,508 | * | 6/1997 | Okawa et al. | 347/70 |
| 5,956,058 | * | 9/1999 | Momose | 347/71 |

FOREIGN PATENT DOCUMENTS

| | | |
|---|---|---|
| 0652108 | 5/1995 | (EP) . |
| 0 670 218 | 6/1995 | (EP) . |
| 0 732 208 | 9/1996 | (EP) . |

OTHER PUBLICATIONS

Patent Abstracts of Japan vol. 13, No. 147 (E–741) Apr. 11, 1989 & JP 63 308390 A (Yokogawa Electric Corp) Dec. 15, 1988 *Abstract.

Patent Abstracts of Japan vol. 15, No. 248 (C–8943), Jun. 25, 1991, & JP 03 080200 A (Fujitsu Ltd) Apr. 4, 1991 *Abstracts.

* cited by examiner

*Primary Examiner*—John Barlow
*Assistant Examiner*—Raquel Yvette Gordon
(74) *Attorney, Agent, or Firm*—Sughrue, Mion, Zinn, Macpeak & Seas, PLLC

(57) ABSTRACT

An ink jet recording head includes: a piezoelectric body element 20 that is formed on a silicon substrate 10; an ink cavity 15 that is formed at a location of the silicon substrate 10 corresponding to the piezoelectric body element 20; and a jetting port 18 for jetting ink contained in the ink cavity 15. The ink cavity 15 has a beamlike ion implanted layer 19 that is not only interposed between at least a pair of confronting side walls 15*a* and 15*b* thereof while coming in contact with desired regions of such side walls 15*a* and 15*b*, but also formed so as to be distanced from other side walls 15*c* and 15*d* thereof.

17 Claims, 4 Drawing Sheets

FIG. 3 (1)
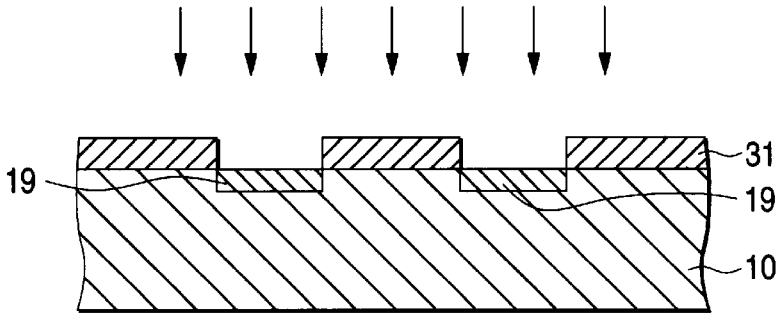
FIG. 3 (2)
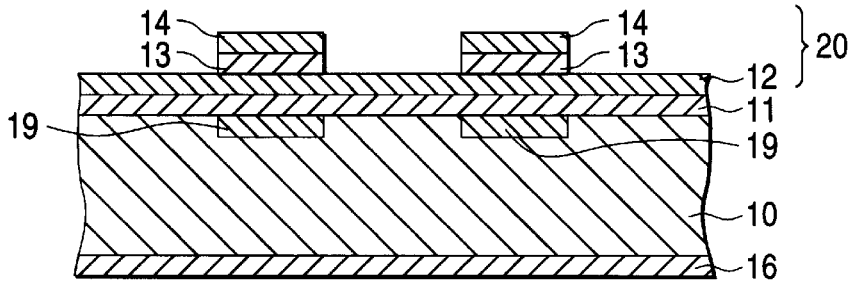
FIG. 3 (3)
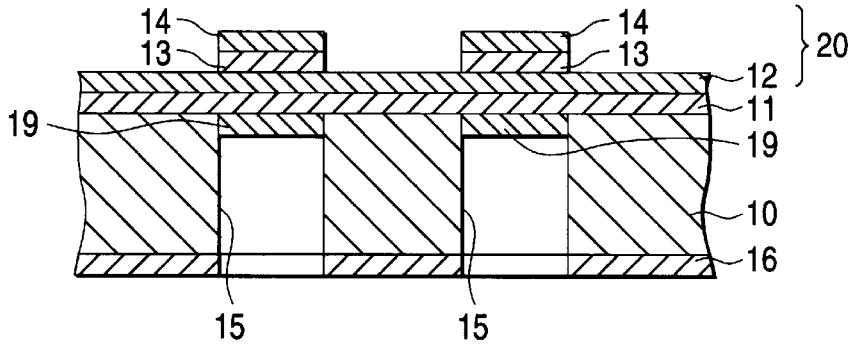
FIG. 3 (4)
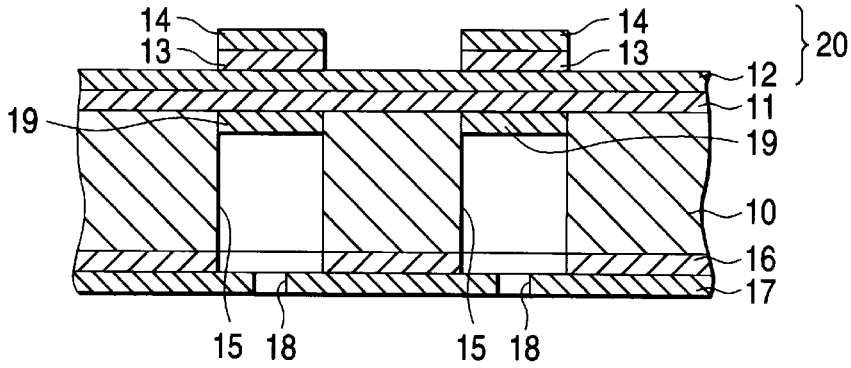

FIG. 6 (1)
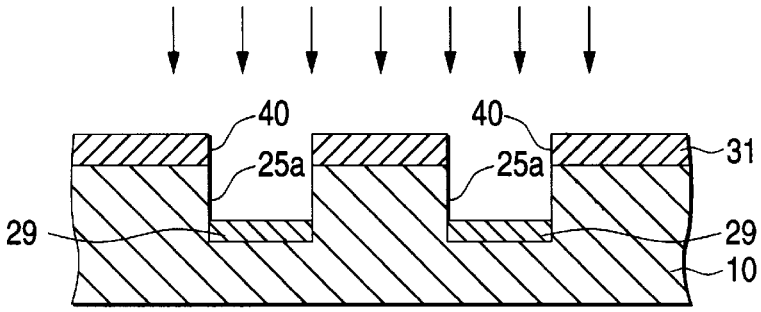
FIG. 6 (2)
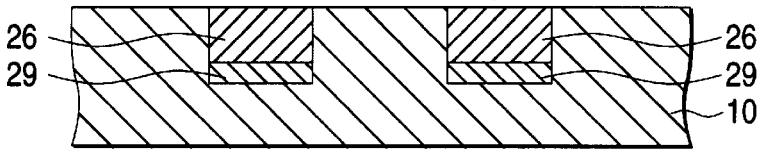
FIG. 6 (3)
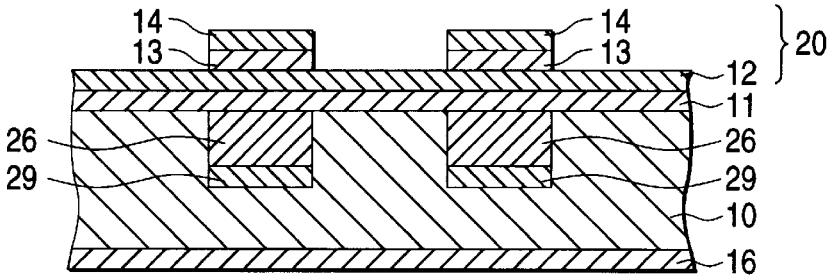
FIG. 6 (4)
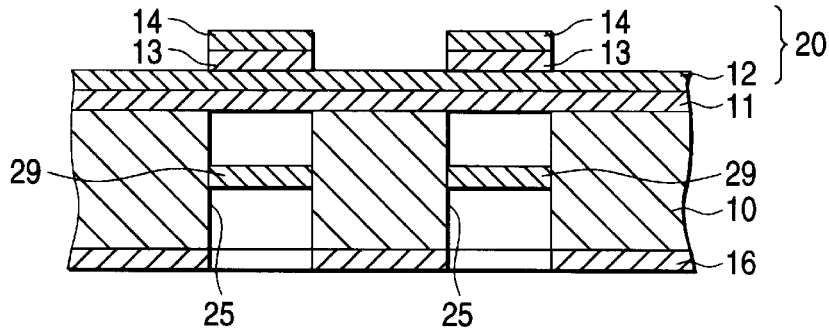
FIG. 6 (5)
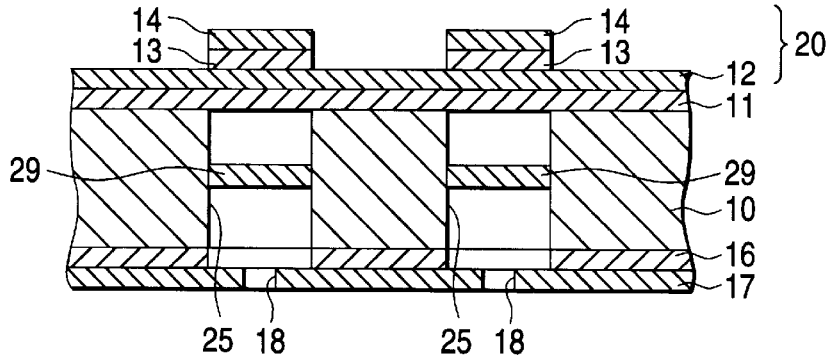

INK JET RECORDING HEAD AND PROCESS OF MANUFACTURING THE INK JET RECORDING HEAD

BACKGROUND OF THE INVENTION

The invention relates to an ink jet recording head and a process of manufacturing such an ink jet recording head. More particularly, the invention is directed not only to an ink jet recording head with improved ink injecting speed at which ink is jetted out of the ink cavities, but also to a process of manufacturing such an ink jet recording head.

An ink jet recording head using a piezoelectric body element as an ink jetting drive source, i.e., as an element for converting electric energy to mechanical energy has heretofore been known. The piezoelectric body element is formed by interposing lead titanate zirconate (hereinafter referred to as "PZT") between a lower electrode and an upper electrode.

This ink jet recording head generally includes: a head substrate having a plurality of ink cavities formed therein; a vibrating plate mounted on the head substrate so as to cover all the ink cavities; a piezoelectric body element attached to portions of the vibrating plate corresponding to the ink cavities; and a nozzle plate arranged on the head substrate so as to close the ink cavities. It may be noted that the nozzle plate has ink jetting ports for jetting out ink contained within the ink cavities.

The thus constructed ink jet recording head is designed to displace the piezoelectric body element by applying an electric field thereto and to apply pressure to a desired ink cavity so that the ink contained in such a desired ink cavity is squeezed outward from a corresponding ink jetting port. Each of the cavities is formed to have such a capacity (volume) as to allow satisfactory printing to be carried out. Here, this ink jet recording head is designed to have as many ink cavities as possible in a narrow surface area so that reproducibility and artistic appearance of tiny characters, graphics, pictures, and the like can be improved. To achieve this object, the ink cavities are designed to be deep enough to reliably meet the aforementioned capacity (volume) requirement.

However, such a conventional ink jet recording head addresses the following problem. In the conventional ink jet recording head, the piezoelectric body element utilizing a thin-film piezoelectric mechanism is formed on the front surface of a silicon wafer and the ink cavities are laid out on the back surface of the silicon wafer at locations confronting the piezoelectric body element. Silicon wafers that can actually be handled during manufacturing processes are 100 mm in diameter and as thin as 200 $\mu$m, and if ink cavities are formed at such a high density as to allow high-definition printing to be achieved, side walls partitioning individual ink cavities must be thin. As a result, the side walls are susceptible to deformation, which in turn prevents ink particles from being jetted therethrough efficiently as well as speedily.

Further, if an inexpensive silicon wafer that is 150 mm or more in diameter is used, the silicon wafer thickness that can be handled becomes about 500 $\mu$m, which in turn requires that this wafer have deeper ink cavities. As a result, arises the problem that the side walls are susceptible to distortion and deformation due to displacement of the piezoelectric body element.

As a result, when pressure is applied to an ink cavity by displacement of the piezoelectric body element, it is difficult to utilize such pressure for correct and efficient ink jetting operation. Hence, the problem of impaired ink injecting speed occurs.

SUMMARY OF THE INVENTION

The present invention has been made to overcome these problems caused by the conventional art. The object of the invention is, therefore, to provide not only an ink jet recording head that prevents the side walls of an ink cavity from being deformed when pressure is applied to the ink cavity by displacement of the piezoelectric body element, so that ink injecting speed can be improved, but also a process of manufacturing such ink jet recording head.

To achieve the above object, the invention is applied to an ink jet recording head that includes: a piezoelectric body element being formed on a substrate; an ink cavity being formed at a location of the substrate corresponding to the piezoelectric body element; an ink jetting port for jetting ink contained within the ink cavity, wherein the ink cavity has a beamlike portion that is not only interposed between a pair of confronting side walls while coming in contact with desired regions of the side walls, but also formed so as to be distanced from other side walls. The thus constructed ink jet recording head is characterized as allowing the beamlike portion to support the confronting side walls of the ink cavity. Therefore, the side walls of an ink cavity are prevented from being distorted or deformed at the time of squeezing outward the ink contained in the ink cavity from the corresponding ink jetting port by displacing the piezoelectric body element while applying an electric field thereto. The displaced piezoelectric body element applies pressure to the ink cavity to thereby cause such pressure to squeeze the ink contained in the ink cavity outward.

The beamlike portion may be interposed between the pair of side walls so as to be substantially perpendicular to the side walls. As a result of such an arrangement, the pair of side walls can be supported more reliably.

Further, the desired regions may be located more toward the piezoelectric body element than a middle portion of the ink cavity. As a result of such an arrangement, ink jetting operation can be performed efficiently in addition to the aforementioned advantages.

The invention also provides a process of manufacturing an ink jet recording head having a piezoelectric body element being formed on a substrate, an ink cavity being formed at a location of the substrate corresponding to the piezoelectric body element, and an ink jetting port for jetting ink contained within the ink cavity, the process involving the steps of: selectively adding an impurity to a desired portion in a region of the substrate in which to form the ink cavity; forming the piezoelectric body element on the impurity-added substrate; and forming the ink cavity by selectively etching a portion of the substrate corresponding to the piezoelectric body element.

Further, the invention provides a process of manufacturing an ink jet recording head having a piezoelectric body element being formed on a substrate, an ink cavity being formed at a location of the substrate corresponding to the piezoelectric body element, and an ink jetting port for jetting ink contained within the ink cavity, the process including the steps of: selectively etching a desired portion of a region of the substrate in which to form the ink cavity; adding an impurity to the etched region of the substrate; charging silicon into the etched portion after the impurity has been added; flattening the silicon-charged surface of the substrate; forming the piezoelectric body element on the flattened substrate; and forming the ink cavity by selectively etching a portion of the substrate corresponding to the piezoelectric body element.

As a result of these steps, the beamlike portion that is not only interposed between the confronting side walls while coming in contact with the desired regions of the side walls but also formed so as to be distanced from other side walls, can be formed.

Further, the step of selectively etching a desired portion of a region of the substrate in which to form the ink cavity may be carried out at a location more toward the piezoelectric body element than the middle portion of the ink cavity.

BRIEF DESCRIPTION OF THE DRAWINGS

FIGS. 3(1), 3(2), 3(3) and 3(4) are sectional views showing the process steps of manufacturing the ink jet recording head shown in FIG. 1.

FIGS. 6(1), 6(2), 6(3), 6(4) and 6(5) are sectional views showing the process steps of manufacturing the ink jet recording head shown in FIG. 4.

DESCRIPTION OF THE PREFERRED EMBODIMENTS

An ink jet recording head, which is the mode of embodiment 1 of the invention, will now be described with reference to the drawings.

Figure 1:
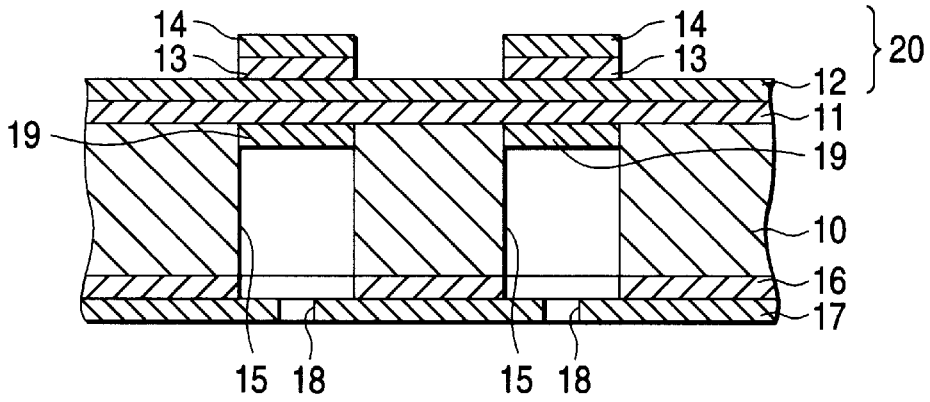
FIG. 1 is a sectional view showing part of an ink jet recording head, which is the mode of embodiment 1 of the invention.
Figure 2:
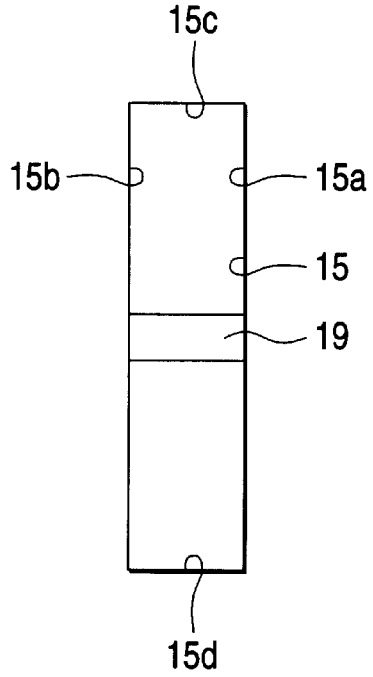
FIG. 2 is a plan view of an ink cavity of the ink jet recording head shown in FIG. 1 as viewed from a nozzle plate arranging surface.

As shown in FIGS. 1 and 2, the ink jet recording head, which is the mode of embodiment 1, includes: a silicon substrate 10 having a plurality of ink cavities arranged therein; a piezoelectric body element 20 formed through a thermal oxide film 11 that is formed on the silicon substrate 10; and a nozzle plate 17 arranged on a silicon substrate 10 surface opposite to the surface on which the piezoelectric body element 20 is formed, the nozzle plate 17 being formed through a silicon oxide film 16.

The piezoelectric body element 20 includes: a lower electrode 12; a PZT (lead titanate zirconate) film 13 formed on the lower electrode 12 so as to correspond to the locations at which the ink cavities are formed; and an upper electrode 14 formed on the PZT film 13.

Ink jetting ports 18 are formed in the nozzle plate 17. The ink jetting ports 18 jet out the ink contained in the ink cavities 15.

A beamlike impurity added layer 19 is formed within an ink cavity 15. The impurity added layer 19 is not only interposed between a pair of side walls 15*a* and 15*b* of the ink cavity 15 substantially in the middle of the pair of side walls 15*a* and 15*b* (see FIG. 2) as viewed in the longitudinal direction while coming in contact with an end portion of the ink cavity 15 on the piezoelectric body element 20 side, but also formed so as to be distanced from other side walls 15*c* and 15*d* of the ink cavity 15. This impurity added layer 19 functions as a beam that supports the side walls 15*a* and 15*b*.

The thus constructed ink jet recording head has the feature that the impurity added layer 19 functions as a beam that supports the confronting side walls 15*a* and 15*b* of the ink cavity 15. As a result of the impurity added layer 19, the side walls of the ink cavity 15 are prevented from being distorted or deformed at the time of squeezing outward the ink contained in the ink cavity 15 from the corresponding ink jetting port 18 by displacing the piezoelectric body element 20 while applying an electric field thereto, and by causing the displaced piezoelectric body element 20 to apply pressure to the ink cavity 15 to thereby cause such pressure to squeeze the ink contained in the ink cavity 15 outward. Hence the pressure can be utilized correctly and efficiently for an ink jetting operation, which in turn contributes to improving the ink injecting speed.

A process of manufacturing this ink jet recording head will be described below in accordance with the process steps shown in FIG. 3.

In the process step shown in FIG. 3(1) a resist film 31 is formed over regions excluding desired ink cavity forming regions on the silicon substrate 10 having a crystal face (100). It may be noted that an ion implantation process is used as a process of forming the impurity added layer 19 in this mode of embodiment. That is, the resist film 31 that has a pattern for forming the impurity added layer 19 (ion implanted layer) on the portions shown in FIGS. 1 and 2, is formed. Then, boron ions ($B^+$) are implanted onto the silicon substrate 10 with the resist film 31 as a mask. The boron implantation is carried out at a density of $1\times10^{20}$ $cm^{-3}$ to $2\times10^{20}$ $cm^{-3}$ and at a depth of 1 to 2 $\mu$m from the front surface of the silicon substrate 10. This is how the beam-like impurity added layer 19 is formed, the impurity added layer 19 being not only interposed between the pair of side walls 15*a* and 15*b* of the ink cavity 15 substantially in the middle of the pair of side walls 15*a* and 15*b* as viewed in the longitudinal direction, while coming in contact with the end portion of the ink cavity 15 on the piezoelectric body element 20 side, but also formed so as to be distanced from other side walls 15*c* and 15*d* of the ink cavity 15. The impurity added layer 19 is, as will be described later in detail, provided with resistance against an etching solution used during an etching process performed at the time of forming the ink cavities 15.

Then, in the process step shown in FIG. 3(2) the resist film 31 formed during the process shown in FIG. 3(1) is removed. Then, the silicon substrate 10 is subjected to a thermal oxidation process to thereby form thermal oxidation films (silicon oxidation films) 11 and 16. Then, a lower electrode forming film, a PZT film, and an upper electrode forming film (not shown) are sequentially formed on the thermal oxidation film 11. Then, the upper electrode forming film and the PZT film are patterned to thereby form the upper electrode 14 and the PZT film 13 having desired profiles, and the lower electrode forming film is thereafter patterned to thereby form the lower electrode 12. This is how the piezoelectric body element 20 that is formed of the lower electrode 12, the PZT film 13, and the upper electrode 14 is formed at predetermined locations on the thermal oxidation film 11.

Then, in the process step shown in FIG. 3(3) the thermal oxidation film 16 and the silicon substrate 10 are selectively etched sequentially to thereby form the ink cavities 15. Here, while a solution of potassium hydroxide is used as an etching solution for the etching of the silicon substrate 10, the aforementioned impurity added layer 19, because of its resistance against the etching solution, is left present within the ink cavities 15 without being etched. That is, since the etch rate of the impurity added layer 19 is largely different from that of crystal face (100) of the silicon substrate 10, the impurity added layer 19 remains unetched within the ink cavities 15.

Then, in the process step shown in FIG. 3(4) the thermal oxidation film 16 is subjected to predetermined process steps such as arranging the nozzle plate 17 with the ink jetting ports 18 bored therein, so that the ink jet recording head is completed.

While the case where the impurity added layer 19 is formed only at one location has been described in this mode of embodiment, the invention is not limited to this case. That is, the impurity added layer 19 may be formed at two or more locations as long as ink jetting performance is not disturbed. Further, the locations of the impurity added layer 19 may also be determined arbitrarily.

Further, while the impurity added layer 19 is formed by an ion implantation process in this mode of embodiment, processes to be used in the invention is not limited thereto. That is, the impurity added layer 19 may be formed by other processes such as a diffusion process and a process in which a heat treatment is carried out by selectively applying an impurity.

Then, an ink jet recording head, which is the mode of embodiment 2, will be described with reference to the drawings.

Figure 4:
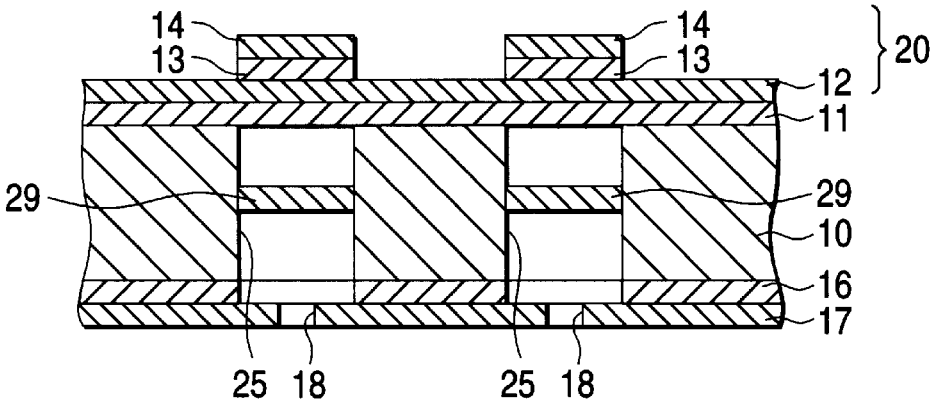
FIG. 4 is a sectional view showing part of an ink jet recording head, which is the mode of embodiment 2 of the invention.
Figure 5:
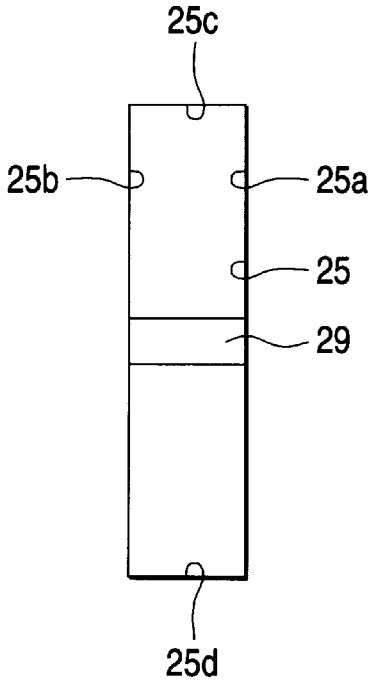
FIG. 5 is a plan view of an ink cavity of the ink jet recording head shown in FIG. 4 as viewed from a nozzle plate arranging surface.

FIG. 4 is a sectional view showing part of an ink jet recording head, which is the mode of embodiment 2 of the invention. FIG. 5 is a plan view of an ink cavity of the ink jet recording head shown in FIG. 4 as viewed from a nozzle plate arranging surface. FIGS. 6(1) to (5) are sectional views showing the process steps of manufacturing the ink jet recording head shown in FIG. 4. It may be noted that in the mode of embodiment 2, parts and components similar to those of mode of embodiment 1 are denoted by the similar reference numerals, and detailed descriptions thereof will be omitted.

The ink jet recording head according to mode of embodiment 2 is distinguished from the ink jet recording head according to mode of embodiment 1 in the locations of the ion implanted layer that plays the role of a beam.

As shown in FIGS. 4 and 5, the ink jet recording head according to mode of embodiment 2 includes: a silicon substrate 10 having a plurality of ink cavities 25 arranged therein; a piezoelectric body element 20 formed through a thermal oxidation film 11 that is formed on the silicon substrate 10; and a nozzle plate 17 formed on a silicon substrate 10 surface opposite to the surface on which the piezoelectric element 20 is formed, the nozzle plate 17 being formed through a silicon oxide film 16.

A beamlike impurity added layer 29 is formed within an ink cavity 25. The impurity added layer 29 is not only interposed between a pair of side walls 25*a* and 25*b* of the ink cavity 25 substantially in the middle of the pair of side walls 25*a* and 25*b* as viewed in the longitudinal direction, while coming in contact with a location of the ink cavity 25 slightly displaced toward the piezoelectric body element 20, but also formed so as to be distanced from other side walls 25*c* and 25*d* of the ink cavity 25. This impurity added layer 29 functions as a beam that supports the side walls 25*a* and 25*b*.

Similarly to the recording head described in the mode of embodiment 1, the thus constructed ink jet recording head has the feature that the impurity added layer 29 functions as a beam that supports the confronting side walls 25*a* and 25*b* of the ink cavity 25. As a result of the impurity added layer 29, the side walls of the ink cavity 25 are prevented from being distorted or deformed at the time of squeezing outward the ink contained in the ink cavity 25 from the ink jetting port 18 by displacing the piezoelectric body element 20 while applying an electric field thereto, and by causing the displaced piezoelectric body element 20 to apply pressure to the ink cavity 25 to thereby cause such pressure to squeeze the ink contained in the ink cavity 25 outward. Hence the pressure can be utilized correctly and efficiently for ink jetting operation, which in turn contributes to improving the ink injecting speed.

Then, a process of manufacturing the ink jet recording head will be described in accordance with the process steps shown in FIG. 6.

Similarly to the mode of embodiment 1, in the process step shown in FIG. 6(1) a resist film 31 is formed on the silicon substrate 10. Then, with this resist film 31 as a mask, the silicon substrate 10 having crystal face (100) is etched to a depth of about ⅓ with respect to the thickness of the silicon substrate 10, to thereby form grooves 40. Then, boron ions ($B^+$) are implanted onto the silicon substrate 10 with the resist film 31 as a mask. The ion implantation is carried out at a density of $1\times10^{20}$ $cm^{-3}$ to $2\times10^{20}$ $cm^{-3}$ and at a depth of 1 to 2 $\mu$m from the front surface of the silicon substrate 10. This is how the beam-like impurity added layer 29 is formed, the impurity added layer being not only interposed between the pair of side walls 25*a* and 25*b* of the ink cavity 25 substantially in the middle of the pair of side walls 25*a* and 25*b* as viewed in the longitudinal direction, while coming in contact with a location of the ink cavity 25 slightly displaced toward the piezoelectric body element 20, but also formed so as to be distanced from other side walls 25*c* and 25*d* of the ink cavity 25. The impurity added layer 29 is also provided with resistance against an etching solution used during an etching process performed at the time of forming the ink cavities 25 similarly to that described with reference to the mode of embodiment 1.

Then, in the process step shown in FIG. 6(2) the resist film 31 formed during the process step shown in FIG. 6(1) is removed. Then, amorphous silicon 26 is deposited on the silicon substrate 10, and the amorphous silicon 26 is charged into the grooves 40. Then, the resist film 31 is removed to thereby flatten the surface of the silicon substrate 10.

Then, in the process step shown in FIG. 6(3) the silicon substrate 10 formed during the process step shown in FIG. 6(2) is subjected to a thermal oxidation process to thereby form thermal oxidation films (silicon oxidation films) 11 and 16. Then, the piezoelectric body element 20 is formed on the thermal oxidation film 11 by a process similar to the mode of embodiment 1.

Then, in the process step shown in FIG. 6(4) the thermal oxidation film 16 and the silicon substrate 10 are selectively etched sequentially to thereby form the ink cavities 15. Here, while a solution of potassium hydroxide is used as an etching solution for the etching of the silicon substrate 10, the aforementioned impurity added layer 29, because of its resistance against the etching solution, remains present within the ink cavities 15 without being etched. That is, since the etch rate of the impurity added layer 29 is largely different from that of crystal face (100) of the silicon substrate 10, the impurity added layer 29 remains unetched within the ink cavities 15.

Then, in the process step shown in FIG. 6(5) the thermal oxidation film 16 is subjected to predetermined process steps such as arranging the nozzle plate 17 with the ink jetting ports 18 bored therein, so that the ink jet recording head is completed.

While the case where the silicon substrate 10 is etched to a depth of about ⅓ with respect to the thickness thereof with the resist film 31 as a mask has been described in the mode of embodiment 2, the invention is not limited thereto. That is, the etch depth may be arbitrarily determined as long as the ink jetting performance is not impaired.

Further, while the case where the amorphous silicon 26 is charged into the grooves 40 has been described in the mode of embodiment 2, the invention is not limited thereto. That is, other substances such as polycrystalline silicon may be charged into the grooves 40 as long as the etch rate of such substance with respect to the etching solution can be equivalent to the etch rate of the silicon substrate 10.

While the case where the impurity added layer 29 is formed only at one location has been described in this mode of embodiment, the invention is not limited thereto. That is, the impurity added layer 29 may be formed at two or more locations as long as ink jetting performance is not disturbed. Further, the locations of the impurity added layer 29 may also be determined arbitrarily.

Further, while the impurity added layer 29 is formed by an ion implantation process in this mode of embodiment, processes to be used in the invention are not limited thereto. That is, the impurity added layer 29 may be formed by other processes such as a diffusion process and a process in which a heat treatment is carried out by selectively applying an impurity.

As described in the foregoing, according to the invention, a beamlike portion that is not only interposed between at least a pair of confronting side walls while coming in contact with desired regions of such pair of side walls, but also formed so as to be distanced from other side walls is arranged within each of the ink cavities. Therefore, the confronting side walls of an ink cavity can be supported by this beamlike portion. As a result, the side walls of the ink cavity are prevented from being distorted or deformed at the time of squeezing outward the ink contained in the ink cavity from the ink jetting port by displacing the piezoelectric body element while applying an electric field thereto, and by causing the displaced piezoelectric body element to apply pressure to the ink cavity to thereby cause such pressure to squeeze the ink contained in the ink cavity outward. Hence the pressure can be utilized correctly and efficiently for an ink jetting operation, which in turn allows an ink jet recording head with improved ink injecting speed to be provided.

In addition, the invention can achieve a higher density of ink cavities and facilitate utilization of inexpensive large-sized silicon wafers.

While particular embodiments of the invention have been shown and described, it will be obvious to one skilled in the art that changes and modifications can be made without departing from the spirit and scope of the invention as defined in the appended claims.

What is claimed is:

1. An ink jet recording head comprising:

a piezoelectric body element being formed on a substrate;

an ink cavity being formed at a location of the substrate corresponding to the piezoelectric body element, said ink cavity being elongated so as to have a pair of confronting side walls which are longer than a pair of further side walls; and and ink jetting port for jetting ink contained within the ink cavity, wherein the cavity has a beamlike portion that is interposed between the pair of confronting side walls while coming in contact with desired regions of the confronting side walls, and formed so as to be distanced from the further side walls, and wherein the desired regions are located more toward the piezoelectric body element than a middle portion of the ink cavity.

2. An ink jet recording head according to claim 1, wherein the beamlike portion is interposed between the pair of confronting side walls so as to be substantially perpendicular to the confronting side walls.

3. An ink jet recording head according to claim 1, wherein the beamlike portion has a thickness which is less than a depth of the ink cavity.

4. An ink jet recording head according to claim 1, wherein an impurity added into said impurity added layer is boron.

5. An ink jet recording head according to claim 4, wherein an ion density of said boron is within a range from $1\times10^{20}$ to $2\times10^{20}$ $cm^{-3}$.

6. An ink jet recording head comprising:

a piezoelectric body element being formed on a substrate;

an ink cavity being formed at a location of the substrate corresponding to the piezoelectric body element, said ink cavity being elongated so as to have a pair of confronting side walls which are longer than a pair of further side walls; and an ink jetting port for jetting ink contained within the ink cavity, wherein the ink cavity has a beamlike portion that is interposed between the pair of confronting side walls while coming in contact with desired regions of the confronting side walls, and formed so as to be distanced from the further side walls, and wherein the beamlike portion comprises an impurity added layer formed within the ink cavity.

7. An ink jet recording head according to claim 6, wherein an impurity added into said impurity added layer is boron.

8. An ink jet recording head according to claim 7, wherein an ion density of said boron is within a range from $1\times10^{20}$ to $2\times10^{20}$ $cm^{-3}$.

9. An ink jet recording head comprising:

a piezoelectric body element being formed on a substrate;

an ink cavity being formed at a location of the substrate corresponding to the piezoelectric body element;

an ink jetting port for jetting ink contained within the ink cavity; and a beamlike portion disposed so as to extend across the ink cavity in a direction perpendicular to a displacement direction of the piezoelectric body element, such that both ends of the beamlike portion support one pair of confronting side walls of the ink cavity in order to prevent the side walls from deforming according to the displacement of the piezoelectric body element.

10. The ink jet recording head according to claim 9, wherein the beamlike portion is provided such that both ends thereof support a desired position of the side walls in a depth direction of the ink cavity.

11. An ink jet recording head comprising:

a piezoelectric body element being formed on a substrate;

a plurality of ink cavities being formed at a location of the substrate corresponding to the piezoelectric body element and arranged side by side; and an ink jetting port for jetting ink contained within the respective ink cavities, wherein each of said ink cavities has a beamlike portion coming in contact with at least two side walls defining said respective ink cavities.

12. An ink jet recording head according to claim 11, wherein the beamlike portion is interposed between a pair of confronting side walls so as to be substantially perpendicular to the confronting side walls.

13. An ink jet recording head according to claim 11 or 12, wherein the beamlike portion is located more toward the piezoelectric body element than a middle portion of the respective ink cavities.

14. An ink jet recording head according to claim 11, wherein the beamlike portion has a thickness which is less than a depth of the respective cavities.

15. An ink jet recording head according to claim 11, wherein the beamlike portion comprises an impurity added layer formed within the respective ink cavities.

16. An ink jet recording head according to claim 11, wherein an impurity added into said impurity added layer is boron.

17. An ink jet recording head according to claim 16, wherein an ion density of said boron is within a range of $1\times10^{20}$ to $2\times10^{20}$ $cm^{-3}$.

* * * * *